US005222383A

United States Patent [19]

Fann et al.

[11] Patent Number: 5,222,383

[45] Date of Patent: Jun. 29, 1993

[54] CYLINDER LOCK

[75] Inventors: Yaw-Shin Fann, Chiayi City; Rong-Faa Wu; Ching-Chuan Kuo, both of Chiayi Hsien, all of Taiwan

[73] Assignee: Tong-Lung Metal Industry Co., Ltd., Taiwan

[21] Appl. No.: 880,527

[22] Filed: May 8, 1992

[51] Int. Cl.[5] ..... E05B 27/06

[52] U.S. Cl. ..... 70/358; 70/359; 70/409; 70/493

[58] Field of Search ..... 70/358, 359, 493, 494, 70/406, 421, 389, 420, 453, 407, 409, 419, DIG. 37

[56] References Cited

U.S. PATENT DOCUMENTS

| | | | |
|---|---|---|---|
| 917,365 | 4/1909 | Schoell | 70/359 |
| 1,095,500 | 5/1914 | Hansen | 70/359 |
| 1,438,336 | 12/1922 | Schroeder | 70/453 |
| 2,030,836 | 2/1936 | Full et al. | 70/358 |
| 3,742,744 | 7/1973 | Lumme | 70/358 |
| 4,142,389 | 3/1979 | Bahry et al. | 70/359 |
| 4,429,554 | 2/1984 | Litvin et al. | 70/493 X |
| 4,478,061 | 10/1984 | Preddey | 70/358 |
| 4,603,565 | 8/1986 | Strassmeir | 70/493 X |
| 4,760,722 | 8/1988 | Fann et al. | 70/358 |
| 4,823,575 | 4/1989 | Florian et al. | 70/493 X |
| 4,856,309 | 8/1989 | Eizen | 70/359 |

FOREIGN PATENT DOCUMENTS

| | | | |
|---|---|---|---|
| 2551794 | 3/1985 | France | 70/493 |
| 207599 | 11/1923 | United Kingdom | 70/493 |

*Primary Examiner*—Lloyd A. Gall

*Attorney, Agent, or Firm*—Ladas & Parry

[57] ABSTRACT

A cylinder lock has a cylindrical plug which is formed with a longitudinally extending keyway and which has a plurality of pin tumblers extending into the keyway. Each of the pin tumblers has a cylindrical outer part and a concentric inner part telescopically slidable within the outer part. A key is inserted into the keyway and has a tumbler activating side which is formed with a longitudinally extending groove, a groove base having projections and/or recesses formed therein and a pair of upwardly extending key blades joined by the groove base. The inner part of each of the pin tumblers has a distal end which extends into the groove and which engages a corresponding one of the projections and/or recesses. The key blades are formed with matching key bit grooves which engage the outer parts of the pin tumblers. Each of the key bit grooves has a groove bottom which is disposed above the groove base, thereby permitting a relatively large difference between the lengths of the inner and outer parts of the pin tumblers so as to increase correspondingly the number of possible lock combinations and the difficulty in picking the cylinder lock.

4 Claims, 3 Drawing Sheets

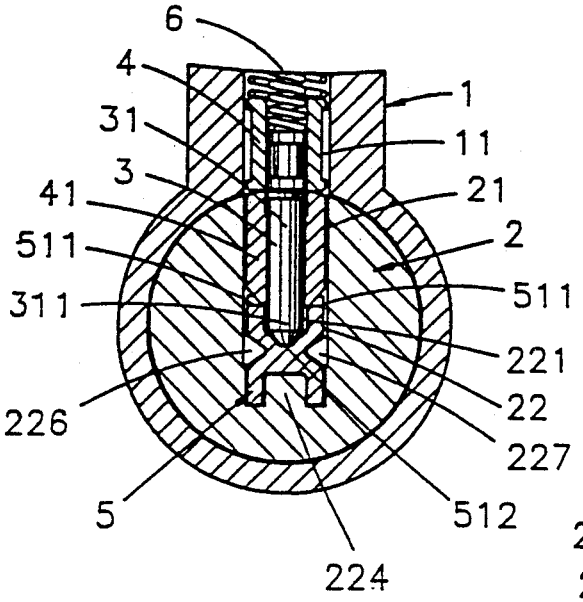
FIG.6
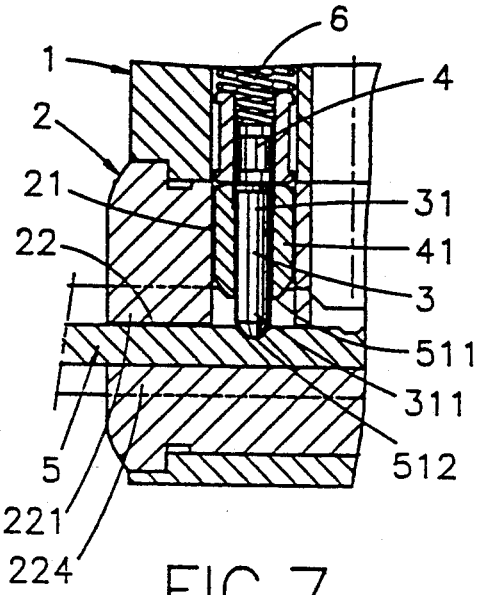
FIG.7
FIG.5
PRIOR ART
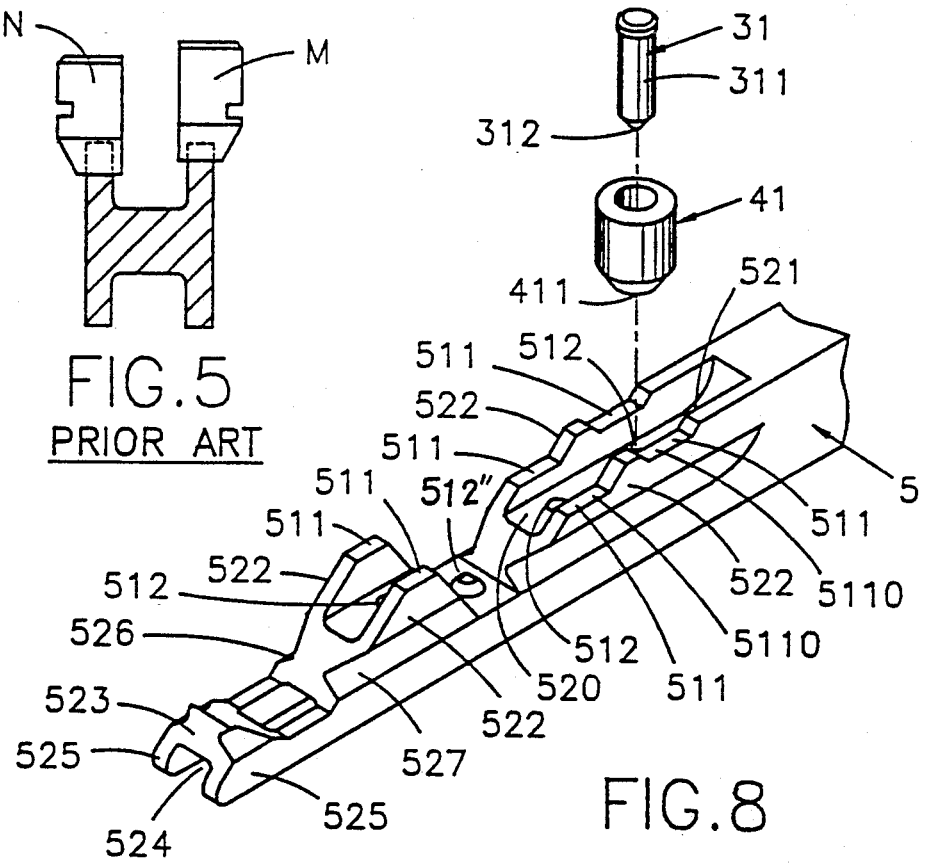
FIG.8

CYLINDER LOCK

BACKGROUND OF THE INVENTION

1. Field of the Invention

The invention relates to a cylinder lock, more particularly to improvements relating to a cylinder lock which includes pin tumblers that have cylindrical outer parts and concentric inner parts telescopically slidable within the outer parts.

2. Description of the Related Art

A first example of a conventional cylinder lock, similar to that disclosed in U.S. Pat. No. 1,095,500, is shown in FIGS. 1 and 2. A key (A) has a tumbler activating edge which is formed with a series of substantially V-shaped key bit grooves (only one key bit groove is shown). Each of the key bit grooves has a flat bottom (a) which engages the lower end of an inner part (b) of a respective pin tumbler. Each of the key bit grooves is defined by a pair of inclined sides (c) which engage the lower end of a concentric cylindrical outer part (d) of the respective pin tumbler. Note that the angle formed between the inclined sides (c) should be kept within a specified range. If the angle between the inclined sides (c) is relatively large, insertion or drawing of the key (A) from the keyway can be easily accomplished. However, the resulting difference (L) in the lengths of the inner part (b) and the outer part (d) of the pin tumbler is relatively small, thereby making it easier to pick the cylinder lock. If the angle between the inclined sides (c) is relatively small, difficulty in the insertion or drawing of the key (A) from the keyway is encountered. The resulting friction between the key (A) and the outer part (d) of the pin tumbler can reduce the effective life of the key (A).

A second example of a conventional cylinder lock, similar to those disclosed in U.S. Pat. Nos. 4,142,389 and 4,856,309, is shown in FIGS. 3 and 4. A key (B) has a planar face which is formed with a series of concentric recesses along a longitudinal axis thereof. The bottom (e) of an innermost recess of the key (B) engages the lower end of the inner part (f) of a respective pin tumbler. The bottom (g) of an outermost recess of the key (B) engages the lower end of the cylindrical outer part (h) of the respective pin tumbler. Note that the difference (L') in the depths of the innermost and outermost recesses should be within a specified range. Disengagement of the inner part (f) of the pin tumbler from the innermost recess of the key (B) is difficult to conduct if the difference (L') is relatively large. A relatively small difference (L'), however, will make it easier to pick the cylinder lock.

Note that the cylinder locks shown in FIGS. 1 to 4 can be easily picked if the difference in the lengths of the inner and outer parts of the pin tumbler is relatively small. Lock picking can be accomplished by inserting a vibrating picking tool into the keyway so as to activate the pin tumblers in sequence. A slight turning pressure is applied on the key plug as the cylinder lock is picked so that alignment of one end of the picked pin tumbler with the shear line can be maintained.

Another example of a conventional cylinder lock has been disclosed in U.S. Pat. No. 4,478,061. The cylinder lock includes two sets of tumblers. The tumblers of each set are aligned longitudinally and are arranged in a generally parallel co-extensive relationship. FIG. 5 illustrates how a key disclosed in U.S. Pat. No. 4,478,061 activates a pair of tumblers (M, N). The key can be U-shaped or H-shaped in cross-section and has a pair of teethed key blades which are adapted to activate the tumblers (M, N) independently.

Note that the tumblers of the cylinder lock disclosed in U.S. Pat. No. 4,478,061 are dissimilar from those installed in the first two examples. The cylinder lock is therefore more complicated and is more difficult to construct.

SUMMARY OF THE INVENTION

Therefore, the main objective of the present invention is to provide an improved cylinder lock which includes pin tumblers that have cylindrical outer parts and concentric inner parts telescopically slidable within the outer parts, a key of the cylinder lock permitting the difference in the lengths of the inner and outer parts of the pin tumbler to be larger than those in conventional cylinder lock constructions, thereby increasing the number of possible lock combinations and making the cylinder lock more difficult to pick.

Accordingly, the preferred embodiment of a cylinder lock of the present invention comprises:

a lock shell with a cylindrical hole;

a rotatable cylindrical plug fittingly provided within the hole of the lock shell and being formed with a longitudinally extending keyway;

first bore means in the plug for receiving pin tumblers therein, said first bore means having axes which are substantially normal to the axis of the plug;

second bore means in the lock shell for receiving pin tumblers therein, said second bore means being aligned with the first bore means;

first tumbler means received in the first bore means;

second tumbler means received in the second bore means;

said first and second tumbler means having cylindrical outer parts and concentric inner parts telescopically slidable within the outer parts;

biasing means in the lock shell for forcing the second tumbler means into the first bore means and for forcing the first tumbler means into the keyway to prevent rotation of the plug relative to the lock shell; and a key means inserted into the keyway so as to move the first tumbler means to force the second tumbler means out of the first bore means to permit rotation of the plug relative to the lock shell, said key means having a tumbler activating side formed with a longitudinally extending groove, a groove base having projections and/or recesses formed therein and a pair of upwardly extending key blades joined by the groove base, said inner part of each of the first tumbler means having a distal end which extends into the groove and which engages a corresponding one of the projections and/or recesses when the key is inserted into the keyway, said key blades being formed with matching key bit grooves to engage the outer parts of the first tumbler means, each of the key bit grooves having a groove bottom which is disposed above the groove base, thereby permitting a relatively large difference between the lengths of the inner and outer parts of the first tumbler means so as to increase correspondingly the number of possible lock combinations and the difficulty in picking the cylinder lock.

BRIEF DESCRIPTION OF THE DRAWINGS

Other features and advantages of the present invention will become apparent in the following detailed description of the preferred embodiments, with reference to the accompanying drawings, of which:

FIG. 5 illustrates how the key of a third example of a conventional cylinder lock actuates pin tumblers of the same;

FIG. 6 is a vertical cross-section of the first preferred embodiment of an improved cylinder lock according to the present invention;

FIG. 7 is a longitudinal cross-section of the cylinder lock shown in FIG. 6;

FIG. 8 is a perspective view of a key for the cylinder lock shown in FIG. 6;

DETAILED DESCRIPTION OF THE PREFERRED EMBODIMENTS

Figure 1:
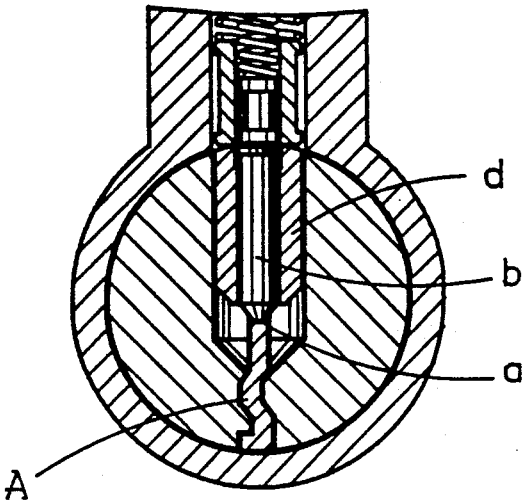
FIG. 1 PRIOR ART
FIG. 1 is a vertical cross-section of a first example of a conventional cylinder lock.
Figure 2:
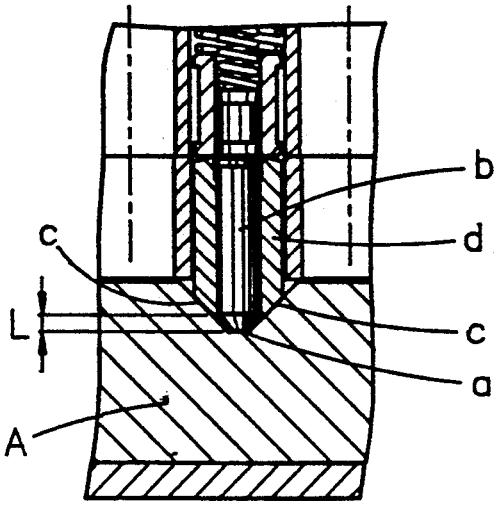
FIG. 2 PRIOR ART
FIG. 2 is a longitudinal cross-section of the conventional cylinder lock shown in FIG. 1.
Figure 3:
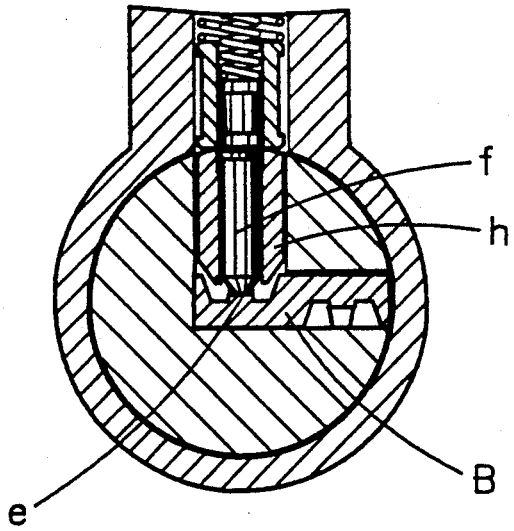
FIG. 3 PRIOR ART
FIG. 3 is a vertical cross-section of a second example of a conventional cylinder lock.
Figure 4:
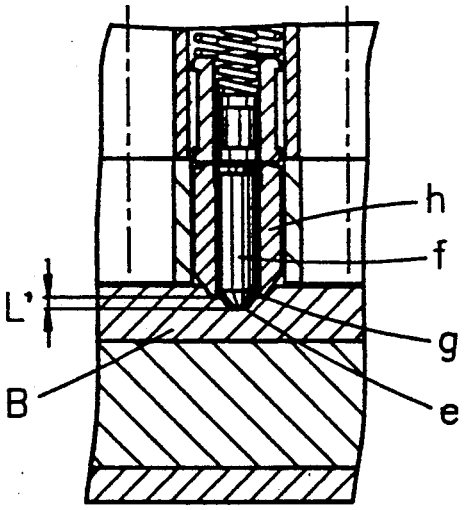
FIG. 4 PRIOR ART
FIG. 4 is a longitudinal cross-section of the conventional cylinder lock shown in FIG. 3.

Referring to FIGS. 6 to 9, the first preferred embodiment of a cylinder lock according to the present invention is shown to comprise a lock shell (1) with a cylindrical hole to receive a rotatable cylindrical plug (2) therein. The plug (2) is formed with a longitudinally extending keyway (22) that is adapted to receive a key (5). The plug (2) is formed with a plurality of first bores (21) [only one bore (21) is shown] which receive a respective first tumbler means (3) and which have axes which are substantially normal to the axis of the plug (2). The lock shell (1) is formed with a plurality of second bores (11) [only one bore (11) is shown] which receive a respective second tumbler means (4) and which are aligned with the first bores (21). The first tumbler means (3), like the second tumbler means (4), have cylindrical outer parts (41) and concentric inner parts (31) telescopically slidable within the muter parts (41). A biasing means (6) is provided in the look shell (1) and forces the second tumbler means (4) into the first bores (21) and further forces the first tumbler means (3) into the keyway (22) so as to prevent rotation of the plug (2) relative to the lock shell (1). The key (5) is inserted into the keyway (22) and moves the first tumbler means (3) to force the second tumbler means (4) out of the first bores (21) to permit rotation of the plug (2) relative to the lock shell (1).

Figure 9:
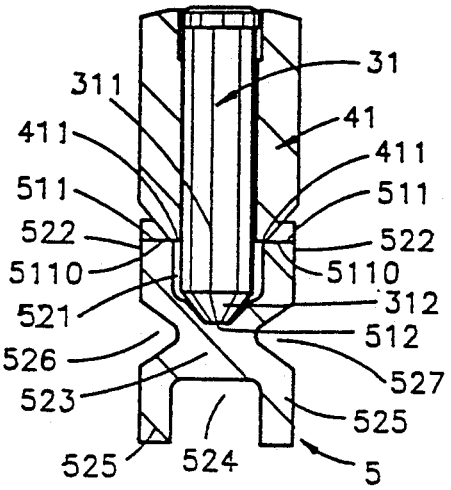
FIG. 9 illustrates how the key shown in FIG. 8 actuates a tumbler means of the cylinder lock of the first preferred embodiment.

Referring to FIGS. 8 and 9, the key (5) has a shank portion (523) with a tumbler activating upper side that is formed with a longitudinally extending groove (521), a groove base (520) having pin recesses (512) and pin projections (512″) [only one pin projection (512″) is shown] of various depths formed therein and a pair of upwardly extending key blades (522) joined by the groove base (520). The shank portion (523) further has a lower side which is opposite to the tumbler activating side and which is similarly formed with a longitudinally extending groove (524). The key (5) is therefore formed with a pair of downwardly extending fins (525) and has a vertical cross-section that is substantially H-shaped. The key (5) also has left and right sides which are respectively formed with a longitudinally extending groove (526, 527). The key blades (522) are formed with matching key bit grooves (511) which engage the lower end of the outer part (41) of a respective one of the first tumbler means (3). Each of the key bit grooves (511) has a groove bottom (5110) which is disposed above the groove base (520). The inner part (31) of each of the first tumbler means (3) extends into the groove (521) and has a distal end (312) which engages a corresponding one of the pin recesses (512) and pin projection (512″).

The groove (521) should be wider than the diameter at a lower portion (311) of the inner part (31) but should be narrower than the outer diameter at a lower portion (411) of the outer part (41). Note that the key (5) of the preferred embodiment permits a relatively large difference between the lengths of the inner and outer parts (31, 41) of the first tumbler means (3) without any adverse effects, unlike the previously described cylinder locks. Note further that the number of possible lock combinations and the degree of difficulty in picking the cylinder lock of the present invention are correspondingly increased without the need for conducting significant modifications in the construction of the plug (2).

Referring once more to FIGS. 6 and 7, the shape of the keyway (22) of the plug (2) should correspond with that of the key (5). The plug (2) is formed with an upper longitudinally extending inward projection (221) to be received in the groove (521), a lower longitudinal inward projection (224) to be received in the groove (524), and left and right inward projections (226, 227) to be received in the grooves (526, 527). The projection (221) is wider than the diameter of the lower portion (311) of the inner part (31). The distance between the projections (226, 227) is smaller than the width of the projection (221). The projections (221, 224, 226, 227) hinder the operation of a lock picking tool so as to prevent the latter from actuating the inner and outer parts (31, 41) of the first tumbler means (3).

Figure 10:
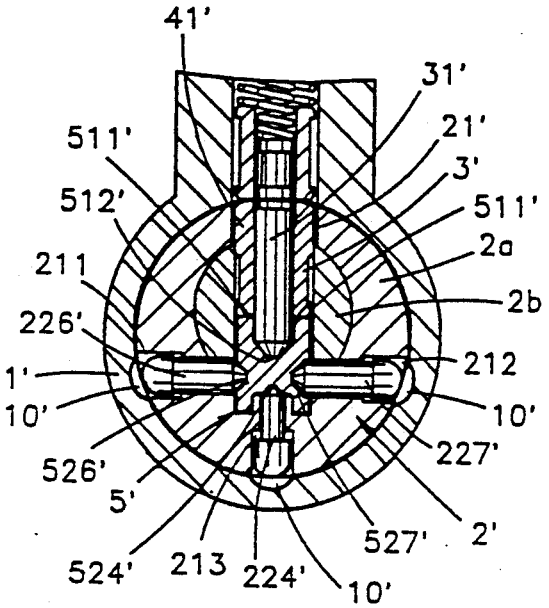
FIG. 10 is a vertical cross-section of the second preferred embodiment of a cylinder lock according to the present invention.
Figure 11:
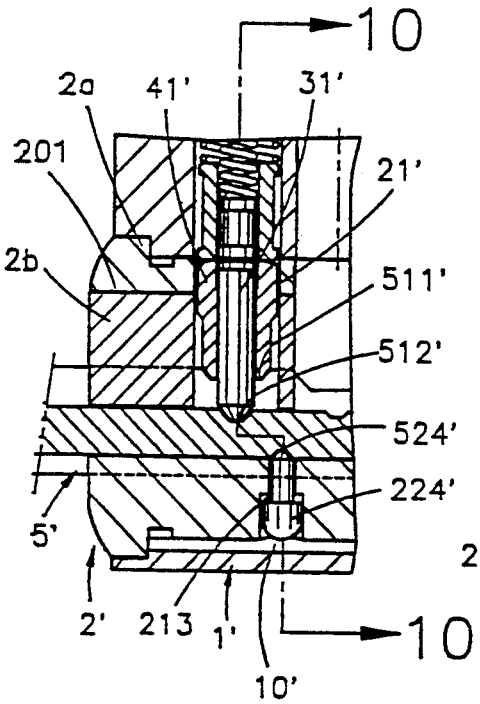
FIG. 11 is a longitudinal cross-section of the cylinder lock shown in FIG. 10.
Figure 12:
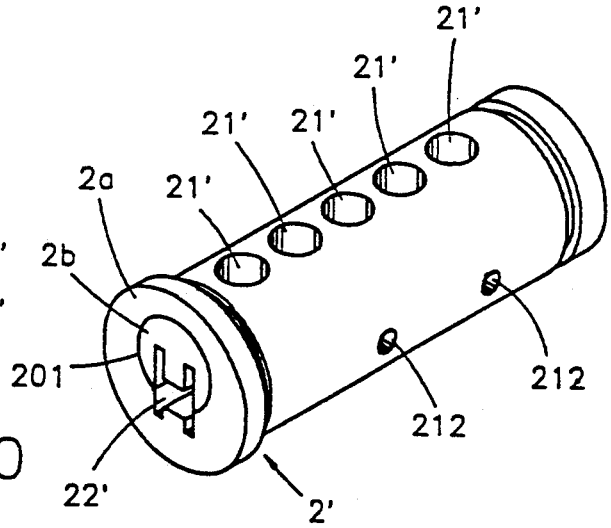
FIG. 12 is a perspective view of a rotatable cylindrical plug of the cylinder lock shown in FIG. 10.

FIGS. 10 to 12 illustrate the second preferred embodiment of a cylinder lock according to the present invention. In contrast with the plug (2) of the first preferred embodiment, the plug (2′) of the second preferred embodiment has an inner part (2*b*) and an outer part (2*a*). The outer part (2*a*) is formed with a longitudinally extending bore (201) for receiving the inner part (2*b*). The inner and outer parts (2*a*, 2*b*) are configured so as to cooperatively form a longitudinal keyway (22′) which has a vertical cross-section that is substantially H-shaped. The plug (2′) is further formed with a plurality of bores (21′) which receive a respective tumbler means (3′). Each of the tumbler means (3′) has a cylindrical outer part (41′) and a concentric inner part (31′) which is telescopically slidable within the outer part (41′). The outer part (41′) engages a corresponding key bit groove (511′) on a key (5′), while the inner part (31′) engages a corresponding pin recess (512′) or pin projection (not shown) formed in the shank portion of the key (5′).

Note that in the first preferred embodiment, the plug (2) is formed with longitudinal projections (224, 226, 227) that are received in the longitudinal grooves (524, 526, 527) of the key (5). In the second preferred embodiment, each of the projections (224, 226, 227) may be replaced by a set of longitudinally aligned radial bores (211, 212, 213) for receiving respective pin tumblers (224', 226', 227') therein.

The lock shell (1') of the second preferred embodiment is formed with longitudinally extending pin grooves (10') which are aligned with the radial bores (211, 212, 213). Each of the pin tumblers (224', 226', 227') has a rounded head which is received in a respective one of the pin grooves (10') and a pin end which extends through a respective one of the bores (211, 212, 213). A plurality of key bit recesses (524', 526', 527') are formed on the key (5') and receive the pin end of the pin tumblers (224', 226', 227') when the key (5') is inserted into the keyway (22'). The rounded head of the pin tumblers (224', 226', 227') move away from the pin grooves (10') and extend fully into the bores (211, 212, 213) when the plug (2') is rotated by the correct key (5') relative to the lock shell (1'). The pin tumblers (224', 226', 227') serve to increase the difficulty in picking the cylinder lock of the present invention.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A cylinder lock, including a lock shell with a cylindrical hole;

a rotatable cylindrical plug fittingly provided within said hole of said lock shell and being formed with a longitudinally extending keyway;

first bore means in said plug for receiving pin tumblers therein, said first bore means having axes which are substantially normal to the axis of said plug;

second bore means in said lock shell for receiving pin tumblers therein, said second bore means being aligned with said first bore means;

first tumbler means received in said first bore means;

second tumbler means received in said second bore means;

said first and said second tumbler means having cylindrical outer parts and concentric inner parts telescopically slidable within the outer parts;

biasing means in said lock shell for forcing said second tumbler means into said first bore means and for forcing said first tumbler means into said keyway to prevent rotation of said plug relative to said lock shell; and a key means inserted into said keyway so as to move said first tumbler means to force said second tumbler means out of said first bore means to permit rotation of said plug relative to said lock shell;

wherein the improvement comprises:

said key means having a tumbler activating side formed with a longitudinally extending groove, a groove base having projections and recesses formed therein and a pair of upwardly extending key blades joined by said groove base, said inner part of each of said first tumbler means having a distal end which extends into said groove and which engages a corresponding one of said projections and recesses when said key means is inserted into said keyway, said key blades being formed with matching key bit grooves to engage said outer parts of said first tumbler means, each of said key bit grooves having a groove bottom which is disposed above said groove base, thereby permitting a relatively large difference between the locations of distal ends of said inner and outer parts of said first tumbler means so as to increase correspondingly the number of possible lock combinations and the difficulty in picking said cylinder lock.

2. The cylinder lock as claimed in claim 1, wherein one of said plug and another side of said key means other than said tumbler activating side is provided with a longitudinal projection and the other one of said pug and said another side of said key means is provided with a second longitudinal groove which receives said longitudinal projection when said key means is inserted into said keyway.

3. The cylinder lock as claimed in claim 1, wherein:

said key means has left and right sides and a lower side opposite to said tumbler activating side, said lower side and at least one of said left and right sides of said key means being formed with a respective second longitudinal groove; and said plug has a longitudinal projection means received in said second longitudinal grooves in said key means when said key means is inserted into said keyway.

4. The cylinder lock as claimed in claim 1, further comprising:

at least one longitudinally extending pin groove formed on an inner surface of said lock shell;

at least one third bore means in said plug and being aligned with a respective said pin groove;

at least one third tumbler means having a rounded head received in a respective said pin groove and a pin end extending through a respective said third bore means; and at least one key bit recess formed on said key means and receiving said pin end of a respective said third tumbler means when said key means is inserted into said keyway, rotation of said plug relative to said lock shell causing said rounded head of said third tumbler means to move away from said pin groove and extend fully into said third bore means.

* * * * *